United States Patent [19]

Nakamura et al.

[11] Patent Number: 4,464,311

[45] Date of Patent: Aug. 7, 1984

[54] VARIABLE VENTURI-TYPE CARBURETOR

[75] Inventors: Norihiko Nakamura; Takaaki Itoh; Takashi Katou, all of Mishima; Yozo Ota, Chiryu; Toshiharu Morino, Mie, all of Japan

[73] Assignees: Toyota Jidosha Kabushiki Kaisha; Aisin Industry Co., Ltd., both of Japan

[21] Appl. No.: 426,831

[22] Filed: Sep. 29, 1982

[30] Foreign Application Priority Data

Dec. 28, 1981 [JP] Japan ..... 54-209792

[51] Int. Cl.[3] ..... F02M 9/06

[52] U.S. Cl. ..... 261/44 C; 261/DIG. 56

[58] Field of Search ..... 261/44 C, 44 B, DIG. 56

[56] References Cited

U.S. PATENT DOCUMENTS

| | | | |
|---|---|---|---|
| 2,062,496 | 12/1936 | Brokel | 261/44 B |
| 4,185,054 | 1/1980 | Nakamura et al. | 261/44 C |
| 4,264,537 | 4/1981 | Watanabe et al. | 261/53 |
| 4,272,460 | 6/1981 | Watanabe et al. | 261/44 C |
| 4,302,404 | 11/1981 | Nakamura et al. | 261/DIG. 38 |
| 4,302,405 | 11/1981 | Inoue et al. | 261/44 C |
| 4,305,893 | 12/1981 | Morino | 261/44 C |
| 4,371,478 | 2/1983 | Wada | 261/44 C |

FOREIGN PATENT DOCUMENTS

| | | | |
|---|---|---|---|
| 972281 | 1/1951 | France | 261/44 B |

*Primary Examiner*—Tim R. Miles

*Attorney, Agent, or Firm*—Finnegan, Henderson, Farabow, Garrett & Dunner

[57] ABSTRACT

A variable venturi-type carburetor comprising a suction piston which has a tip face defining a venturi portion. The tip face has a needle-mounting face at the center thereof, and a metering needle is fixed onto the needle-mounting face. The tip face also has a projecting tip face portion located upstream of the needle and projecting from the needle-mounting face towards the venturi portion. A groove, extending along the axis of the intake passage of the carburetor, is formed on the projecting tip face portion. The projecting tip face portion has a V-shaped cross-section which expands from the groove towards the venturi portion.

6 Claims, 6 Drawing Figures

VARIABLE VENTURI-TYPE CARBURETOR

BACKGROUND OF THE INVENTION

The present invention relates to a variable venturi-type carburetor.

In a variable venturi-type carburetor, in the case wherein the suction piston is so formed that the tip face thereof, which is located upstream of the needle fixed onto the needle-mounting face of the suction piston, projects from the needle-mounting face towards the tip of the needle so as to define the venturi portion between the projecting portion of the tip face of the suction piston and the inner wall of the intake passage, since the upstream side of the needle is covered by the projecting portion of the tip face of the suction piston when the amount of air fed into the cylinder of an engine is small, a problem occurs in that it is difficult to sufficiently vaporize fuel injected from the nozzle. In addition, in the case wherein the variable venturi-type carburetor is a carburetor of the downdraft type, part of the fuel fed from the nozzle flows on the needle and adheres to the needle-mounting face of the suction piston. The fuel adhering to the needle-mounting face then falls off in the form of droplets, and the air-fuel ratio of the mixture fed into the cylinder of the engine fluctuates particularly when the amount of air fed into the cylinder of the engine is small and, as a result, a problem occurs in that the exhaust emission deteriorates.

SUMMARY OF THE INVENTION

An object of the present invention is to provide a variable venturi-type carburetor capable of promoting the atomization of fuel and capable of preventing the air-fuel ratio of the mixture from fluctuating in the case wherein the venturi portion is defined by the projecting portion of the tip face of the suction piston.

According to the present invention, there is provided a variable venturi-type carburetor comprising: an axially-extending intake passage formed in the carburetor; a suction piston transversely movable in said intake passage in response to a change in the amount of air flowing within said intake passage, said suction piston having a tip face which defines a venturi portion in said intake passage and a needle-mounting face; a fuel passage extending transversely and being open to said intake passage; a metering jet arranged in said fuel passage; a needle fixed onto the needle-mounting face of said suction piston and extending through said fuel passage and said metering jet, the tip face of said suction piston having a projecting tip face portion which is located upstream of said needle and projects transversely from said needle-mounting face towards said venturi portion; and a groove formed on said projecting tip face portion and extending along the axis of said intake passage, said groove having an upstream portion and a downstream portion connected to said needle-mounting face, said projecting tip face portion having an approximately V-shaped cross section which expands from said groove towards said venturi portion.

The present invention may be more fully understood from the description of a preferred embodiment of the invention set forth below, together with the accompanying drawings.

DESCRIPTION OF A PREFERRED EMBODIMENT

Figure 1:
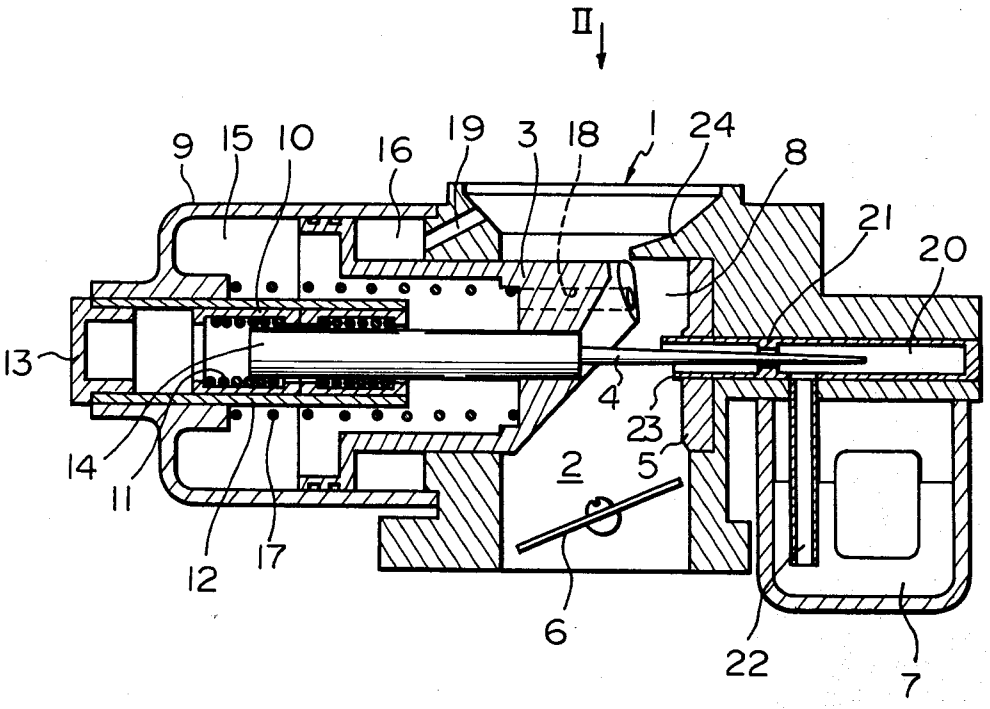
FIG. 1 is a cross-sectional side view of a variable venturi-type carburetor according to the present invention.

Refering to FIG. 1, 1 designates a carburetor body, 2 a vertically-extending intake passage, 3 a suction piston transversely movable in the intake passage 2, and 4 a needle fixed onto the tip face of the suction piston 3; 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. On the other hand, a guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3, and a compression spring 17 for continuously biasing the suction piston 3 towards the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

Fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. Hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects from the lower half of the tip portion of the nozzle 23 towards the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

As illustrated in FIG. 1, a raised wall 24, projecting horizontally into the intake passage 2, is formed at the upper end of the spacer 5, and a flow control is effected between the raised wall 24 and the tip end portion of the suction piston 3. When the engine is started, air flows downwards within the intake passage 2. At this time, since the air flow is restricted between the suction piston 3 and the raised portion 24, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

Referring to FIGS. 3 through 6, the entire tip face portion A of the suction piston 3, which is located upstream of the needle 4, projects from a needle-mounting face 25 towards the tip of the needle 4, and the tip face portion B of the suction piston 3, which is located downstream of the needle 4, is inclined from the needle-mounting face 25 towards the vacuum chamber 15. Consequently, the tip face portion B forms an inclined surface directed downwards. As will be understood from FIGS. 5 and 6, the tip face portions A and B of the suction piston 3 have a symmetrical shape relative to a symmetrical plane a passing through the axis of the intake passage 2, and a groove 26, extending along the symmetrical plane a, is formed on the tip face portion A of the suction piston 3. The upstream end portion 26*a* of the groove 26 has a U-shaped cross section and is located at a position near the tip of the needle 4 relative to the needle-mounting face 25. The remaining portion 26*b* of the groove 26 is substantially straight and extends from the upstream end portion 26*a* to the needle-mounting face 25. In addition, the tip face portion A of the suction piston 3 has a V-shaped cross section which expands from the groove 26 towards the venturi portion 8 and, therefore, the tip face portion A of the suction piston 3 has a pair of inclined wall portions 27*a* and 27*b* each being inclined towards the groove 26. The end portions 28*a* and 28*b* of the inclined wall portions 27*a* and 27*b*, which are located farthest from the symmetrical plane a, are formed in a flat fashion and, as will be understood from FIG. 3, the lower ends of the inclined wall portions 27*a* and 27*b* are connected to the tip face portion B of the suction piston 3. On the other hand, as will be understood from FIGS. 5 and 6, the groove portion 26*b* has a V-shaped cross section, and the cross-sectional area of the groove portion 26*b* is gradually increased as the groove portion 26*b* approaches the needle-mounting face 25.

Figure 2:
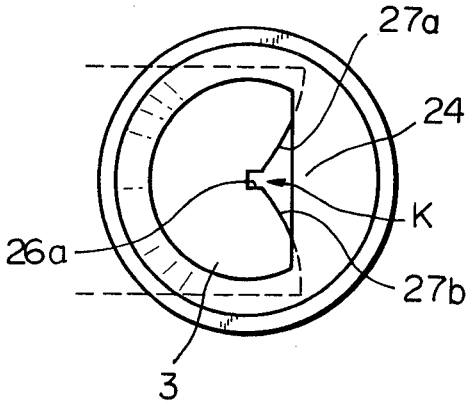
FIG. 2 is a plan view taken along the arrow II in FIG. 1.
Figure 3:
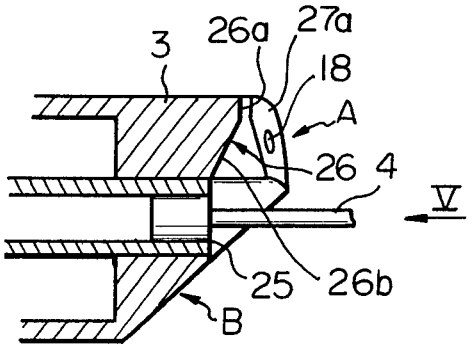
FIG. 3 is a cross-sectional side view of a portion of the suction piston illustrated in FIG. 1.
Figure 4:
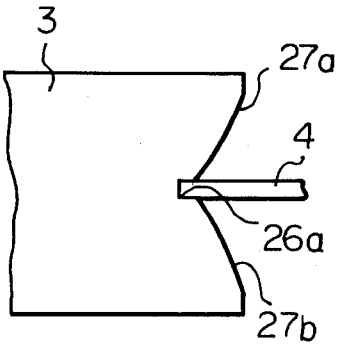
FIG. 4 is a plan view of FIG. 3.
Figure 5:
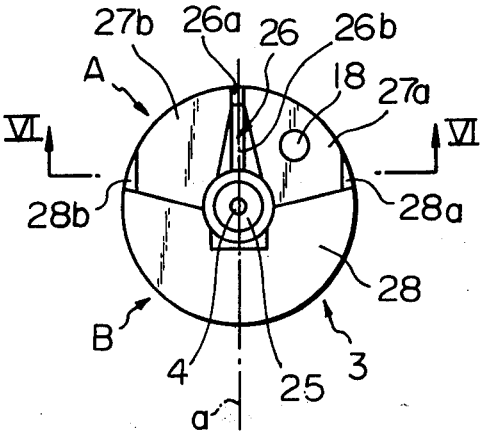
FIG. 5 is a front view of the tip face of the suction piston taken along the arrow V in FIG. 3.
Figure 6:
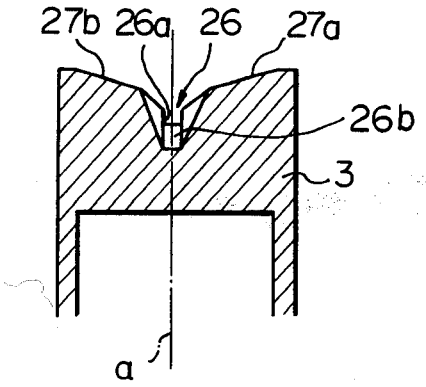
FIG. 6 is a cross-sectional view taken along the line VI—VI in FIG. 5.

As will be understood from FIG. 2, when the amount of air fed into the cylinder of the engine is small, an air-flow-restricting opening K is defined by the raised wall 24, the inclined wall portions 27*a* and 27*b*, and the upstream end portion 26*a* of the groove 26. By forming the air-flow-restricting opening K so that it has an approximately isosceles triangle shape when the amount of air fed into the cylinder of the engine is small, as illustrated in FIG. 2, the suction piston 3 can smoothly move when the amount of air fed into the cylinder of the engine is increased or reduced. The air, which has passed through the air-flow-restricting opening K, flows within the groove 26 and then flows across the tip of the nozzle 23. As a result of this, since fuel flowing out from the nozzle 23 is subjected to a strong shearing force, atomization of the fuel is promoted. In addition, part of the fuel flowing out from the nozzle 23 flows on the needle 4 and adheres to the needle-mounting face 25. However, since part of the air flowing within the groove 26 makes contact with the needle-mounting face 25 via the groove portion 26*b*, the fuel adhering to the needle-mounting face 25 is blown off by said part of air. Consequently, since no fuel droplets are formed on the needle-mounting face 25, it is possible to prevent fluctuation of the air-fuel ratio, which fluctuation is caused by the falling off of fuel droplets.

According to the present invention, even if the amount of air fed into the cylinder of the engine is small, since the air flows across the tip of the nozzle, it is possible to promote atomization of the fuel. In addition, since it is possible to prevent fuel droplets from being formed on the needle-mounting face, it is also possible to prevent fluctuation of the air-fuel ratio, which fluctuation is caused by the falling off of the fuel droplets.

While the invention has been described with reference to a specific embodiment chosen for purposes of illustration, it should be apparent that numerous modifications could be made thereto by those skilled in the art without departing from the basic concept and scope of the invention.

We claim:

1. A variable venturi-type carburetor comprising:
   - an axially-extending intake passage formed in the carburetor;
   - a suction piston transversely movable in said intake passage in response to a change in the amount of air flowing within said intake passage, said suction piston having a tip face which defines the venturi-portion in said intake passage and a needle-mounting face;
   - a fuel passage extending transversely and being open to said intake passage;
   - a metering jet arranged in said fuel passage;
   - a needle fixed onto the needle-mounting face of said suction piston and extending through said fuel passage and said metering jet, the tip face of said suction piston having a projecting tip face portion which is located upstream of said needle and projects transversely from said needle-mounting face towards said venturi portion; and
   - a groove having upstream and downstream portions formed on said projecting tip face portion and extending along the axis of said intake passage, the upstream portion of said groove having a U-shaped cross section and being open to said intake passage located upstream of said suction piston and the downstream portion of said groove being connected to said needle-mounting face and having a bottom which is inclined toward said needle-mounting face from said upstream portion, said projecting tip face portion having an approximately V-shaped cross section which expands from said groove towards said venturi portion.

2. A variable venturi-type carburetor according to claim 1, wherein a raised wall is formed on an inner wall of said intake passage at a position opposite to said suction piston, said projecting tip face portion having an upstream end portion which cooperates with said raised wall for restricting the air flowing into said venturi.

3. A variable venturi-type carburetor according to claim 2, wherein said raised wall and the upstream end portion of said projecting tip face portion define an approximately isosceles triangle-shaped air-flow-restricting opening therebetween when the amount of air flowing within said intake passage is small.

4. A variable venturi-type carburetor according to claim 1, wherein the downstream portion of said groove has a V-shaped cross section having a cross-sectional area which is gradually increased towards said needle-mounting face.

5. A variable venturi-type carburetor according to claim 1, wherein said projecting tip face portion has a pair of inclined wall portions arranged on each side of said groove, each of said inclined wall portions having a flat end portion at a position located farthest from said groove.

6. A variable venturi-type carburetor according to claim 1, wherein the tip face of said suction piston has an inclined tip face portion located downstream of said needle and directed downwards.

* * * * *

UNITED STATES PATENT AND TRADEMARK OFFICE

CERTIFICATE OF CORRECTION

PATENT NO. : 4,464,311

DATED : August 7, 1984

INVENTOR(S) : Norihiko Nakamura et al.

It is certified that error appears in the above—identified patent and that said Letters Patent is hereby corrected as shown below:

Title page:

Please change the spelling of the name of the second assignee to read as follows:

-- Aisan Industry Co., Ltd. --

Signed and Sealed this

*Fifth* Day of *March 1985*

[SEAL]

*Attest:*

DONALD J. QUIGG

*Attesting Officer* *Acting Commissioner of Patents and Trademarks*